US006867381B1

(12) United States Patent
Pan

(10) Patent No.: US 6,867,381 B1
(45) Date of Patent: Mar. 15, 2005

(54) ELECTRONIC DEVICE AND POSITION SENSOR THEREOF

(75) Inventor: Long-Jyh Pan, Sijhih (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/814,994

(22) Filed: Mar. 31, 2004

(30) Foreign Application Priority Data

Nov. 12, 2003 (TW) ..... 92131638 A

(51) Int. Cl.[7] ..... H01H 35/02
(52) U.S. Cl. ..... 200/61.52
(58) Field of Search ..... 200/220, 61.45 R, 200/61.45 M, 61.52, 61.47, 292

(56) References Cited

U.S. PATENT DOCUMENTS 2,892,049 A * 6/1959 Rubinstein ..... 200/61.45 R
3,161,738 A * 12/1964 Hall ..... 200/61.52
3,876,850 A * 4/1975 Amberny ..... 200/220
4,425,488 A * 1/1984 Moskin et al. ..... 200/220
4,503,299 A * 3/1985 Henrard et al. ..... 200/61.52
4,766,275 A * 8/1988 Hemmann et al. ..... 200/277
5,808,254 A * 9/1998 Wu ..... 200/61.45 R
6,087,936 A * 7/2000 Woods ..... 340/566
6,156,982 A * 12/2000 Dawson ..... 200/263

* cited by examiner

*Primary Examiner*—Neil Abrams
(74) *Attorney, Agent, or Firm*—Thomas, Kayden, Horstemeyer & Risley

(57) ABSTRACT

An electronic device and position sensor thereof. The position sensor includes a housing, a first conductor disposed at the bottom of the housing, a plurality of second conductors engaged in the housing and a connector movably disposed in the housing and contacting the first conductor, wherein the contour of the housing limits the connector to connection between the first conductor to one of the second conductors selectively. Varied display modes are thus provided in different positions.

15 Claims, 4 Drawing Sheets

ELECTRONIC DEVICE AND POSITION SENSOR THEREOF

BACKGROUND OF THE INVENTION

1. Field of the Invention

The present invention relates to a position sensor, and in particular to a position sensor capable of electrically connecting conductors at different positions to identify the position of an electronic device.

2. Description of the Related Art

Users of handheld electronic devices such as mobiles phone, personal digital assistants (PDA) or handheld computers may prefer varied display modes when the device is used in different positions. Thus, the electronic device must be provided with a position sensor to detect the position thereof.

SUMMARY OF THE INVENTION

Accordingly, an object of the invention is to provide a device with position sensing ability thereof, changing display mode according to the detected position.

Therefore, the invention provides a position sensor used in an electronic device to detect the position thereof. The position sensor comprises a housing, a first conductor disposed at the bottom of the housing, a plurality of second conductors engaged in the housing, a connector movably disposed in the housing and contact the first conductor. The inner contour of the housing limits the movement of the connector so that the first conductor electrically connects to one of the second conductors by gravity.

The housing has a plurality of engaging portions formed on the periphery thereof engaging the second conductors therein. The connector has a plurality of protrusions corresponding to the engaging portions, contacting the second conductors. The shape of the connector follows the inner contours of the housing. This allows the connector to move in the housing only a short distance to contact the second conductor with the protrusions. The connector has a plurality of convexes on the bottom thereof to contact the first conductor and reduce friction therebetween.

The invention also provides an electronic device utilizing the position sensor. The electronic device comprises a circuit board, a housing having a plurality of engaging portions on the periphery thereof, a first conductive element disposed between the housing and the circuit board, a plurality of second conductive elements disposed on the circuit board with one end thereof and engaging the engaging portion with the other end, and a connector movably disposed in the housing and contacting the first conductive element. The inner contour of the housing limits the movement of the connector so that the first conductive element electrically connects to one of the second conductive elements by gravity, thereby detecting the position of the electronic device.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
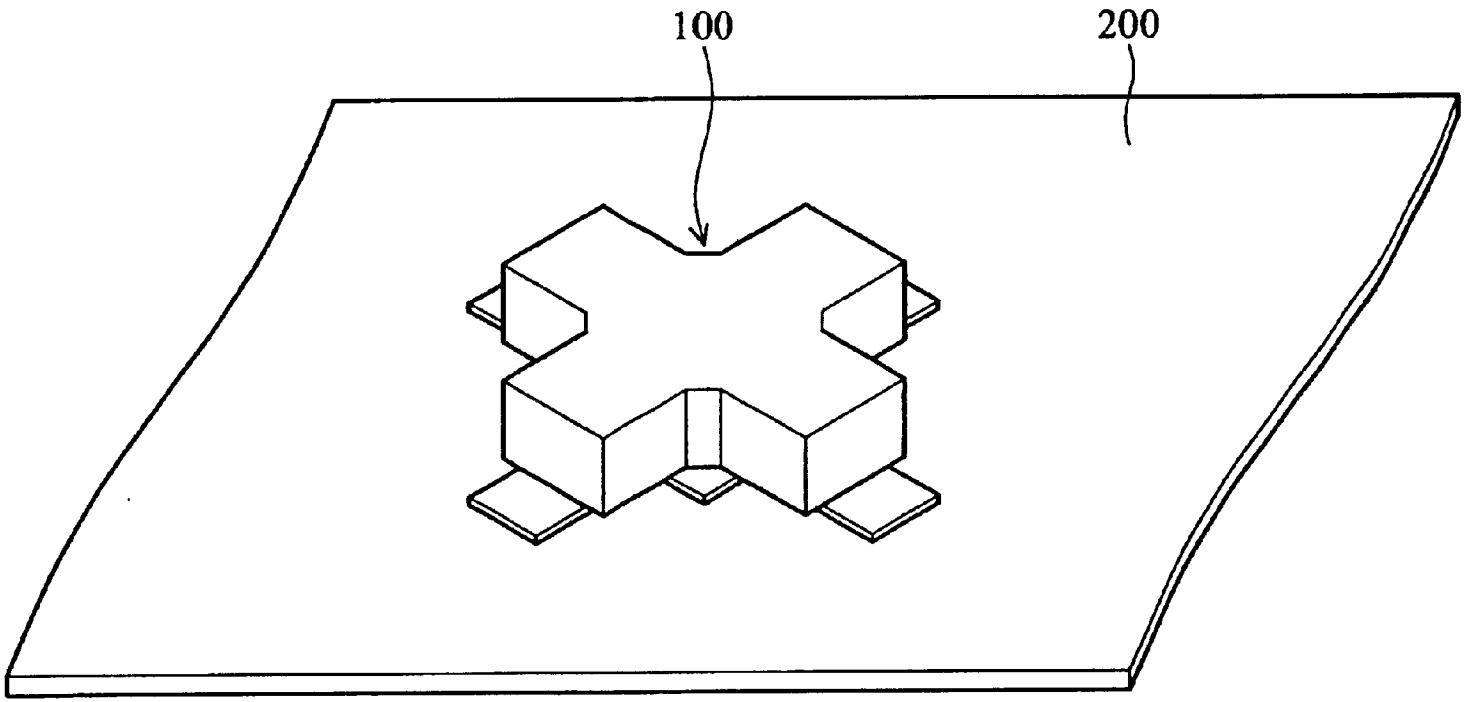
FIG. 1 is a perspective view of the position sensor disposed on a circuit board in the invention.
Figure 2:
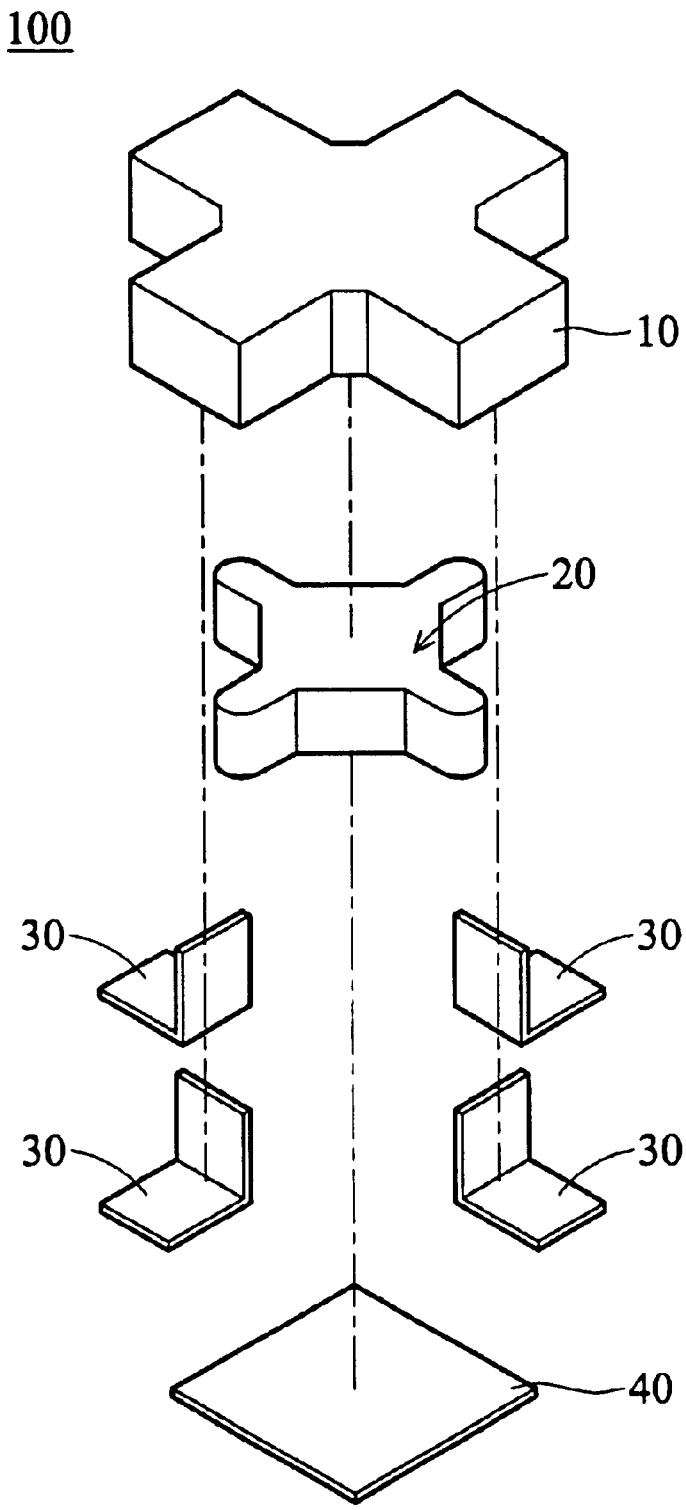
FIG. 2 is an exploded perspective view of the position sensor of the invention.

As shown in FIG. 1, a position sensor 100 is mounted on a circuit board 200 by surface mount technology (SMT). Referring to FIG. 2, the position sensor 100 comprises a housing 10, a connector 20, a first conductive element (first conductor) 40 and four second conductive elements (second conductor) 30. The first conductive element 40 and the four second conductive elements 30 are mounted on the circuit board 200 to electrically connect to different circuits on the circuit board 200.

Figure 3:
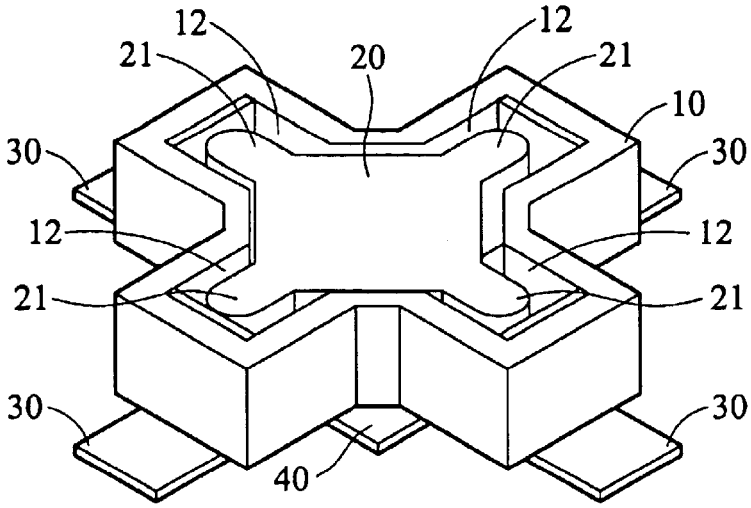
FIG. 3 is a perspective view of the position sensor of the invention with the top of the housing removed.

FIG. 3 is an exploded perspective view of the position sensor of the invention. In FIG. 3, the top of the housing 10 is ignored. As shown in FIG. 3, four U-shaped engaging portions 12 are formed on the periphery of the housing 10, and the second conductive element 30 is configured in an L shape. One end of the L-shaped second conductive element 30 tightly engages the engaging portion 12. As the other end of the second conductive element 30 is fixed on the circuit board 200, the housing 10 is thereby likewise fixed. The first conductive element 40 is disposed between the housing 10 and the circuit board 200, and the connector 20 is disposed in the housing 10, such that the bottom of the connector 20 contacts with first conductive element 40. Therefore, the connector 20 electrically connects one of the second conductive elements 30 allowing electrical signal transmission between the second conductive element 30 and the first conductive element 40.

Referring to FIG. 3, the number of engaging portions 12 is equal to the number of second conductive elements 30. In this embodiment, the connector 20 has four protrusions 21 corresponding to the four engaging portion 12. The shape of the connector 20 is similar to but smaller than the inner periphery of the housing 10, and the connector 20 can slide toward any of the engaging portions 12 to contact one of the second conductive elements 30 with the protrusion 21. The inner contour of the housing 10 limits the connector 20 to contact only one of the second conductive elements 30.

Figure 4:
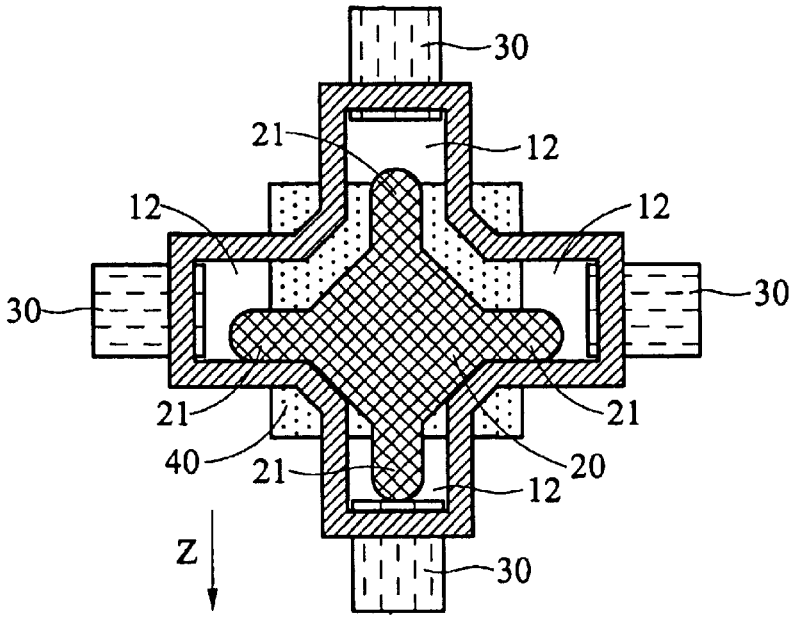
FIG. 4 is a top view of the position sensor of the invention with the top of the housing removed.

In the invention, the connector 20 connects one of the second conductive elements 30 based on the gravity. As shown in FIG. 4, z is the direction of gravity, so the connector 20 moves to contact the second conductive element 30 positioned in z direction. The second conductive elements 30 can be sources sending different signals. The signal from the second conductive element 30 is transmitted to the first conductive element 40 via the connector 20. Thereby, the electronic device can identify positions thereof by recognizing the signal from the second conductive element 30. The second conductive elements 30 can be resistors of different values. The electronic device identifies position thereof by detecting the resistance of the second conductive element 30.

Figure 5:
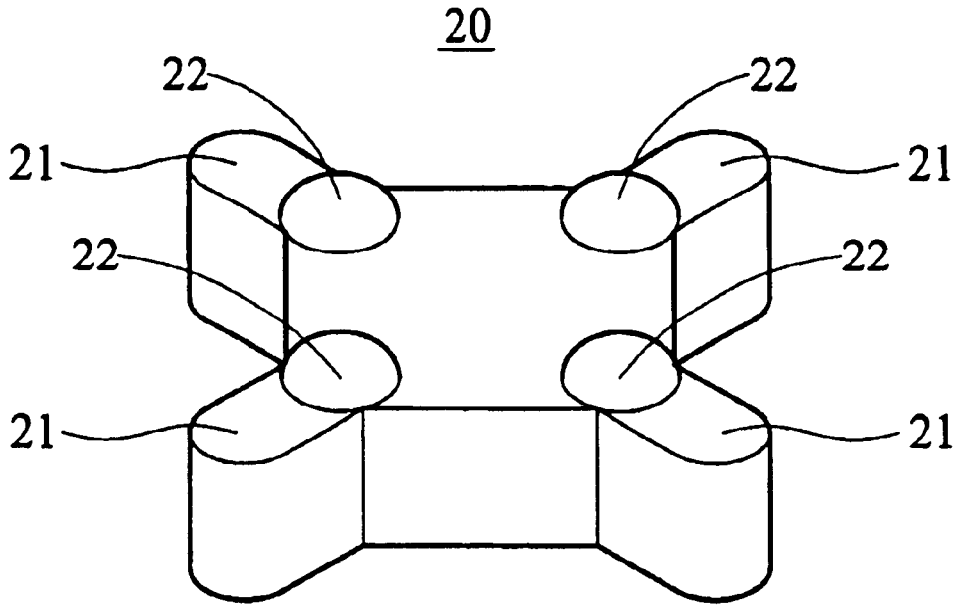
FIG. 5 is a bottom perspective view of the connector of the invention.

FIG. 5 is a bottom perspective view of the connector of the invention. As shown in FIG. 5, a plurality of convexes are formed on the bottom of the connector 20 to ensure contact and reduce friction between the connector 20 and the first conductive element 40 for enhancing sensitivity.

The preferred material of the housing 10 is non-electrical conductive, to avoid short circuit of the first and second conductive elements 40, 30. In general, the material of the housing 10 is plastic. The second conductive element 30 is preferably ferric metal such as stainless steel, and ferromagnetic metal for the connector 20, to reinforce the selective contact therebetween and reduce interference thereon. The first conductive element 40 can be made of non-ferric metal such as copper or metal coated with gold, in view of the contact therebetween.

The electronic device with the position sensor of the invention can identify the position thereof by electrically contacting the first conductive element and the second conductive element. Varied display modes are thus provided in different positions.

Although a position sensor for four directions (four second metal elements) is described in this embodiment, a position sensor for more directions provided by the same structure is also in the scope of the invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A position sensor for an electronic device, comprising:

a housing;

a first conductor disposed at the bottom of the housing;

a plurality of second conductors engaged in the housing; and a connector movably disposed in the housing and comprising a plurality of convexes on a bottom thereof to contact the first conductor and reduce friction therebetween;

wherein the inner periphery of the housing limits the movement of the connector so that the first conductor electrically connects to only one of the second conductors.

2. The position sensor as claimed in claim 1, wherein the periphery of the housing comprises a plurality of engaging portions for engaging the second conductors thereof.

3. The position sensor as claimed in claim 2, wherein the connector comprises a plurality of protrusions corresponding to the engaging portions for contacting the second conductors.

4. The position sensor as claimed in claim 3, wherein the connector contacts each of the second conductors with the protrusions by moving in the housing.

5. The position sensor as claimed in claim 1, wherein the first conductor is a metal sheet.

6. The position sensor as claimed in claim 1, wherein the housing is made of plastic.

7. The position sensor as claimed in claim 1, wherein the first conductor is made of non-ferric metal.

8. The position sensor as claimed in claim 1, wherein the second conductors is are made of ferric metal.

9. The position sensor as claimed in claim 1, wherein the connector is made of ferromagnetic metal to ensure contact between the second conductor and the connector.

10. The position sensor as claimed in claim 1, wherein the second conductors are resistors of different values.

11. The position sensor as claimed in claim 1, wherein the second conductors are signal sources sending different signals.

12. An electronic device with position detection, comprising:

a circuit board;

a housing comprising a plurality of engaging portions on the periphery thereof;

a first conductive element disposed between the housing and the circuit board;

a plurality of second conductive elements disposed on the circuit board with one end thereof and engaging the engaging portion with the other end; and a connector movably disposed in the housing and comprising a plurality of convexes on the bottom thereof to contact the first conductive element and reduce friction therebetween;

wherein the inner periphery of the housing limits the movement of the connector so that the first conductive element electrically connects to only one of the second conductive elements, and thus the position of the electronic device is detected.

13. The electronic device with position detection as claimed in claim 12, wherein the connector comprises a plurality of protrusions corresponding to the engaging portions for contacting the second conductive elements.

14. The electronic device with position detection as claimed in claim 13, wherein the connector contacts each of the second conductive elements with the protrusions by moving in the housing.

15. A position sensor for an electronic device, comprising:

a housing comprising a plurality of engaging portions on the periphery thereof for engaging the second conductors thereof;

a first conductor disposed at the bottom of the housing;

a plurality of second conductors engaged in the housing; and a connector movably disposed in the housing and contacting the first conductor, and comprising a plurality of protrusions corresponding to and capable of inserting into the engaging portions for contacting the second conductors;

wherein the inner periphery of the housing limits the movement of the connector so that the first conductor electrically connects to only one of the second conductors.

* * * * *